US005697345A

United States Patent [19]

Genter et al.

[11] Patent Number: 5,697,345

[45] Date of Patent: Dec. 16, 1997

[54] CLAMPING LOAD DISTRIBUTOR FOR A FUEL INJECTOR

[75] Inventors: David P. Genter; Yul J. Tarr, both of Columbus; David W. Padgett, Westport; Laszlo D. Tikk, Columbus, all of Ind.

[73] Assignee: Cummins Engine Company, Inc., Columbus, Ind.

[21] Appl. No.: 364,698

[22] Filed: Dec. 28, 1994

[51] Int. Cl.[6] ..... F02M 55/02

[52] U.S. Cl. ..... 123/470; 123/509

[58] Field of Search ..... 123/470, 472, 123/456, 509, 469, 468; 239/86–95

[56] References Cited

U.S. PATENT DOCUMENTS

| | | | |
|---|---|---|---|
| 3,387,867 | 6/1968 | Rogers | 285/336 |
| 4,066,213 | 1/1978 | Stampe . | |
| 4,133,321 | 1/1979 | Hofmann | 123/470 |
| 4,403,586 | 9/1983 | Taniguchi | 123/509 |
| 4,419,977 | 12/1983 | Hillebrand | 123/502 |
| 4,519,371 | 5/1985 | Nagase | 123/470 |
| 4,528,959 | 7/1985 | Hauser | 123/470 |
| 4,571,161 | 2/1986 | Leblanc et al. | 123/509 |
| 4,648,556 | 3/1987 | Leblanc | 123/509 |
| 4,829,646 | 5/1989 | Cigolotti et al. | 123/495 |
| 4,917,069 | 4/1990 | Kuhlen . | |
| 4,938,193 | 7/1990 | Raufeissen | 123/470 |
| 5,121,731 | 6/1992 | Jones | 123/470 |
| 5,308,038 | 5/1994 | McArthur . | |

FOREIGN PATENT DOCUMENTS

| | | | |
|---|---|---|---|
| 0022926 | of 1981 | European Pat. Off. | 123/470 |
| 0369151 | 5/1990 | European Pat. Off. | 123/470 |
| 838650 | of 1939 | France . | |
| 3010328 | 9/1981 | Germany | 123/470 |
| 0070952 | 5/1982 | Japan | 123/470 |
| 0074368 | 4/1984 | Japan | 123/470 |
| 4128551 | 4/1992 | Japan | 123/470 |
| 1550204 | 3/1990 | U.S.S.R. | 123/470 |
| 1549740 | 8/1979 | United Kingdom | 123/470 |
| 2177450 | 1/1987 | United Kingdom | 123/470 |
| 2177157 | 11/1987 | United Kingdom | 123/470 |
| WO 84/02161 | 6/1984 | WIPO | 123/470 |

*Primary Examiner*—Carl S. Miller

*Attorney, Agent, or Firm*—Woodard, Emhardt, Naughton, Moriarity & McNett

[57] ABSTRACT

A clamping load distributor disposed and connecting between a fuel injector body and a clamping device. The clamping load distributor functions as an intermediary to transmit the static clamping load from the clamping device to the fuel injector body. The clamping load distributor includes a cylindrically shaped main body having a bore extending therethrough between an upper surface and a lower surface. The upper surface of the main body being adapted for receiving the clamping load from a clamping device. The lower surface having at least one portion normally contacting the deck of the fuel injector body. The clamping device engages the upper surface of the clamping load distributor at a position axially aligned with a portion of the lower surface that normally does not contact the fuel injector body. The geometric relationship of the clamping load distributor functions to more uniformly distribute the static clamping load across the fuel injector body. By spreading the static clamping load more uniformly across the fuel injector body there is a corresponding reduction in timing plunger scuffing, thereby eliminating or minimizing the occurrence of timing plunger seizure.

15 Claims, 6 Drawing Sheets

CLAMPING LOAD DISTRIBUTOR FOR A FUEL INJECTOR

BACKGROUND OF THE INVENTION

The present invention relates in general to the design and construction of clamping rings which are used as an intermediary for transmitting static clamping loads from a clamping device to an object. More particularly, the present invention relates to a clamping load distributor utilized as an intermediary for holding a fuel injector body to the cylinder head of an internal combustion engine.

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling the undesirable by-products of combustion.

A unit injector is a precision device that must meter the quantity of fuel required for each cycle of the engine and must develop the high pressure necessary to inject the fuel into the combustion chamber at the correct instant of the operating cycle. Many fuel injection units utilize a mechanical linkage from the engine, such as a push rod and rocker arm, to pressurize the fuel charge and obtain the desired fuel spray pattern. The mechanical linkage interacts with a timing plunger that is disposed within a bore formed in the fuel injector for engaging an incompressible liquid fuel. This mechanical pressurization of the liquid fuel produces an extremely high fuel injection pressure, often exceeding 20,000 p.s.i. (13,800 Newtons per square centimeter).

In the past, designers of internal combustion engines have generally used a mechanical clamping device to hold a fuel injection unit on the cylinder head. One approach is to affix a clamping device having a wishbone shaped fork at one end to the cylinder head. The clamping device is bolted to the cylinder head and the forks on the wishbone shaped end contact the top surface of the fuel injector body in two places, thereby holding the fuel injector unit in place. A second approach is to utilize a clamping plate that engages a flange formed on the outer perimeter of the fuel injector body. The clamping plate is secured to the engine by one, or a pair of bolts, thereby drawing the flange against the engine block and holding the fuel injector unit in place.

These two approaches of fastening a fuel injector unit to an internal combustion engine have a common limitation. The common limitation being that the mechanical clamping device imparts a concentrated clamping force to a portion of the fuel injector body. The concentrated clamping force distorts the bore formed in the fuel injector body thereby causing timing plunger scuffing, and ultimately the seizure of the timing plunger within the bore. Premature failure of the fuel injector unit is often attributed to the fuel injector body receiving a concentrated clamping load.

In order to try and solve, or at least minimize, the foregoing problem, designers have tried different approaches. For example, there have been a variety of clamping rings, for transferring static clamping loads produced by clamping devices conceived of over the years. The following listing of references is believed to be representative of such earlier designs.

REFERENCES

| Patent No. | Patentee | Issue Date |
|---|---|---|
| 4,829,646 | Cigolotti et al. | May 16, 1989 |
| 4,571,161 | Leblanc et al. | Feb. 18, 1986 |
| 4,419,977 | Hillenbrand | Dec. 13, 1983 |
| 4,403,586 | Taniguchi | Sept. 13, 1983 |
| 3,387,867 | Rogers | June 11, 1968 |
| **Patent No.** | **Applicant** | **Date** |
| French No. 838,650 | Fives-Lille Company | March 10, 1939 |

Even with a variety of earlier designs, there remains a need for a clamping load distributor that is easy to install and which more uniformly distributes the transmission of the concentrated clamping force to the fuel injector body, thereby reducing the distortion of the bore formed in the fuel injector body. The present invention satisfies this need in a novel and unobvious way.

SUMMARY OF THE INVENTION

Figure 1:
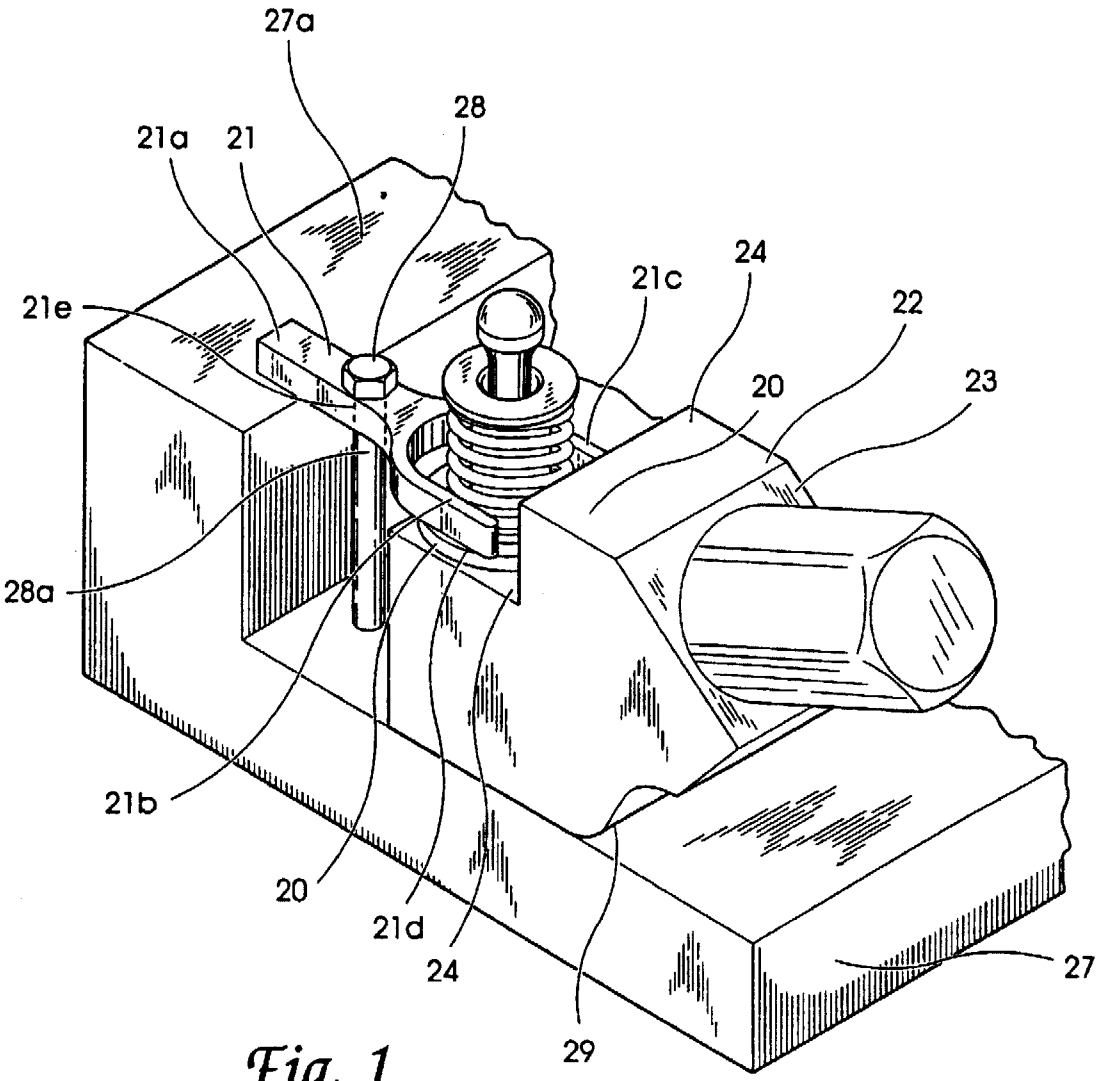
FIG. 1 is a perspective view of a clamping load distributor according to a typical embodiment of the present invention as assembled between a fuel injector body and a clamp.

To address the unmet needs of prior fuel injector unit mounting devices, the present invention contemplates an apparatus disposed between a fuel injector body and a clamping device, the apparatus comprises: a body having a clamp engagement portion for receiving the clamping device, the clamping device imparts a clamping load to the clamp engagement portion of the body when in a loaded condition; the body having a first surface, the first surface having a first portion and a second portion, the first portion of the first surface arranged to normally contact the fuel injector body in an unloaded condition; and the second portion of the first surface contacts the fuel injector body when the clamping load is applied.

A second form of the present invention contemplates an apparatus for securing a fuel injector body to an internal combustion engine, the apparatus comprises: a flexible spring plate having a first surface and a second surface opposite the first surface, at least a portion of the second surface normally disposed adjacent the fuel injector body; the spring plate having an aperture extending therethrough for receiving a portion of the fuel injector body; the spring plate having an edge biased to an outward position away from the fuel injector body but being depressible from the outward position; and a clamp for exerting a clamping load on the upper surface of the flexible spring plate, the clamping load resiliently urging the edge towards the fuel injector body for distributing the clamping load.

One object of the present invention is to provide an improved clamping load distributor for fastening a fuel injector body oil the cylinder head of an internal combustion engine.

Related objects and advantages of the present invention will be apparent from the following description.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a clamping load distributor 20 which is designed and manufactured in accordance with the present invention. Clamping load distributor 20 is designed to reduce the concentrated point loading inherent with a hold down clamp 21, and transmit a more uniformly distributed static clamping load to the fuel injector body 22. The clamping load distributor 20 is positioned on the fuel injector unit 23 between the upper surface 24, of the fuel injector body 22, and the hold down clamp 21.

The hold down clamp 21 is provided for securing the fuel injector body 22 to a cylinder head 27 of an internal combustion engine (not illustrated). In the preferred embodiment the hold down clamp 21 includes a first end 21*a* that contacts upper surface 27*a* of the cylinder head 27. The second opposite end of the hold down clamp 21 defines a pair of forks 21*b* and 21*c* that are formed in a spaced apart relationship with each other. A coplanar lower surface 21*d* of the pair of forks 21*b* and 21*c* is positioned to contact the clamping load distributor 20 when the hold down clamp 21 is mounted to the cylinder head 27. A threaded fastener 28 includes a shaft portion 28*a* that passes through a clearance hole 21*e* formed in the body of the hold down clamp 21. In the preferred embodiment the threaded fastener is a hex head bolt 28. It is further contemplated that the fastener could alternatively be a threaded rod and nut combination. The bolt 28 engages an internally threaded bore formed in the cylinder head 27. The torquing of bolt 28 transmits a hold down clamp static load through the forks 21*b* and 21*c* to the clamping load distributor 20, thereby holding the fuel injector body 22 against a deck 29 of cylinder head 27.

Figure 2:
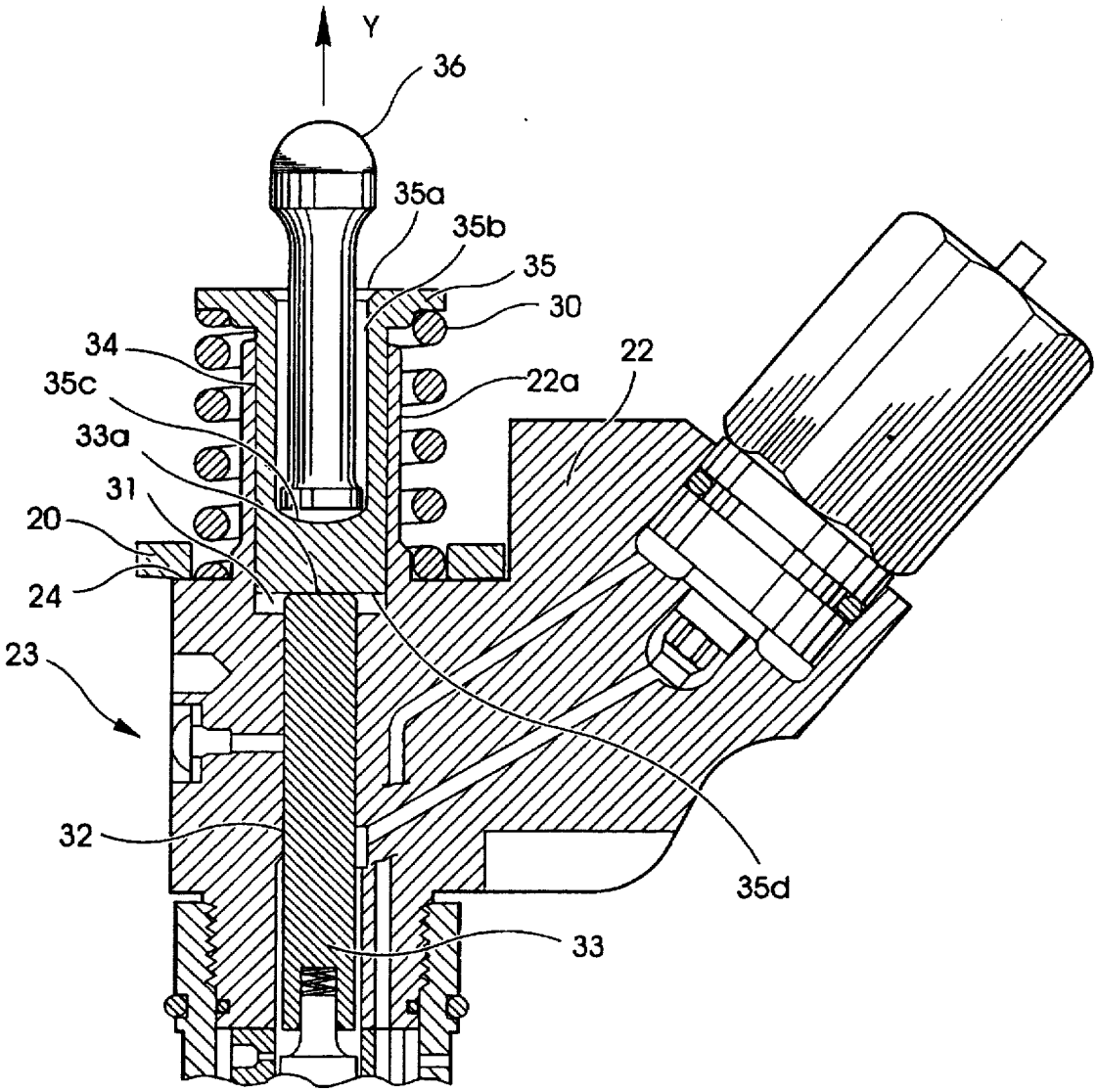
FIG. 2 is a front elevational view in full section of the FIG. 1 clamping load distributor as assembled on the fuel injector body with the clamp removed.

With reference to FIG. 2, there is illustrated the fuel injector unit 23 having a clamping load distributor 20 positioned around a portion of the outer circumference of coupling return spring 30, and contacting the upper surface 24 of fuel injector body 22. The fuel injector body 22 is formed preferably as a forged unit that includes an upstanding cylindrical portion 228, and a central axial cavity 31 extending throughout the length of the fuel injector body 22. The axial cavity 31 is actually comprised of two coaxial and communicating cylindrical bores of different inner diameters. First cylindrical bore 32 is defined in fuel injector body 22 and slideably receives a timing plunger 33. The second cylindrical bore 34 is defined in the upstanding cylindrical portion 22*a* of the fuel injector body 22 and slideably receives a coupling member 35. At the exposed portion 35*a* of the coupling member 35, a bore 35*b* and a load bearing surface 35*c* are formed. A link 36 is disposed within the bore 35*b* and contacts the load bearing surface 35*c* for transmitting a force to the coupling member 35, to overcome the spring force of coupling return spring 30. The link 36 functions in a well known fashion and is typically in contact with a valve train camshaft (not illustrated) of the internal combustion engine. Link 36 reciprocates along a central axis Y in response to the angular position of the actuating valve train camshaft.

The coupling member 35 defines a lower surface 35*d* that is contactable with an upper surface 33*a* of timing plunger 33. In the preferred embodiment there is no mechanical. fixation or attachment between the coupling member 35 and the timing plunger 33; only a compressive load is transmitted from the coupling member 35 to the timing plunger 33. However, in another embodiment there is mechanical attachment between the coupling member and the timing plunger. The compressive load transmitted from the coupling member 35 to the timing plunger 33 causes the axial movement of the timing plunger 33 which functions to pressurize a fuel charge disposed within the fuel injector unit 23.

Figure 3:
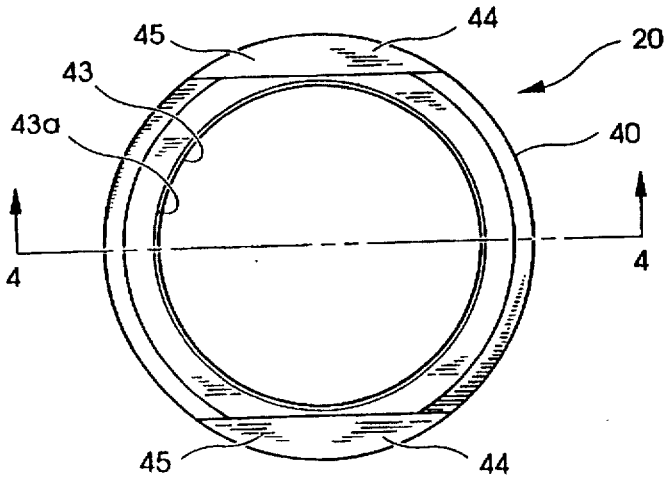
FIG. 3 is a top plan view of the FIG. 1 clamping load distributor.
Figure 4:
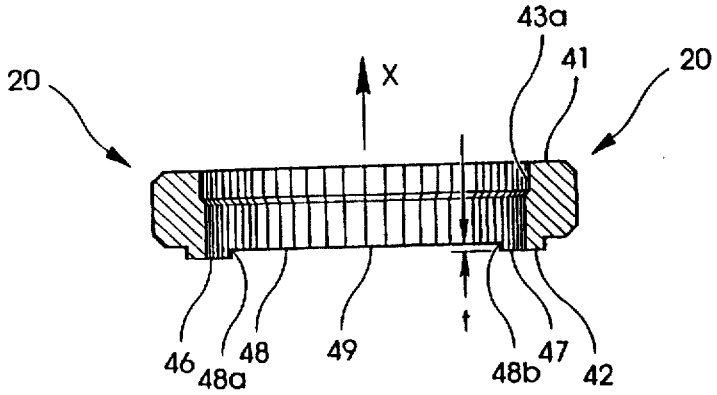
FIG. 4 is a side elevational view in full section taken along line A—A of the FIG. 3 clamping load distributor.
Figure 5:
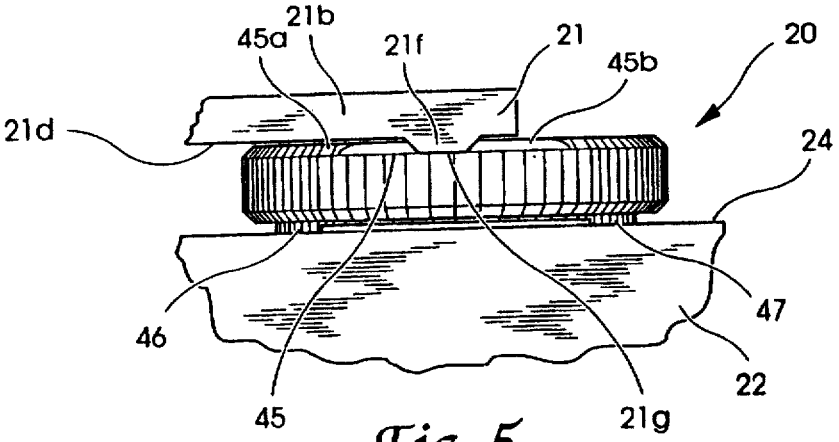
FIG. 5 is a side elevational view of the FIG. 1 clamping load distributor coupled to a fuel injector body.

Referring to FIGS. 3–5, there is illustrated the clamping load distributor 20 having a substantially cylindrical main body 40. In the preferred embodiment the clamping load distributor 20 is of a unitary design and is formed from a steel blank. A predetermined amount of material is removed from the steel blank, by a machining process which utilizes a turning operation and a milling operation to produce the desired geometric configuration described hereinafter. Alternatively, the clamping load distributor 20 can be formed by any other suitable manner which provides a durable ring with the desired dimensions, such as by a sintered powdered metal process or forging.

The main body 40 of time clamping load distributor 20 includes a substantially flat, first upper surface 41, and a substantially flat, second lower surface 42 that is disposed opposite of the first upper surface 41. The first upper surface 41 and the second lower surface 42 are formed substantially parallel to each other. The main body 40 of clamping load distributor 20 has a two-part or shouldered (i.e. counterbored) bore 43 extending therethrough between the first upper surface 41 and the second lower surface 42. The counterbored portion 43*b* provides for greater radial clearance from the upstanding cylindrical portion 22*a* of the fuel injector body 22. An internal diameter surface 43*a* is defined on bore 43, and this internal diameter surface 43*a* is larger than the outside diameter of the coupling return spring 30 that is disposed circumferentially around the upstanding cylindrical portion 22*a* of the fuel injector body 22. This relative difference in diameter size permits the clamping load distributor 20 to be placed during assembly circumferentially around the coupling return spring 30.

The first upper surface 41 of the main body 40 is formed transverse to a longitudinal centerline X of the clamping load distributor 20 and is adapted for receiving the forks 21*b* and 21*c* of hold down clamp 21. The forks 21*b* and 21*c* of hold down clamp 21 are engagable with a pair of clamp receiving portions 44. Clamp receiving portions 44 are formed diametrically opposed from each other on the first upper surface 41 of main body 40. A predetermined amount of material is removed from the steel blank to form the clamp receiving portions 44. The clamp receiving portions 44 are formed by a milling operation which utilizes a milling cutter to remove the desired quantity of material on the main body 40. Alternatively, the clamp receiving portions 44 can be formed by any other suitable manner which provides the desired geometric shape. In the preferred embodiment clamp receiving portions 44 define a clamp receiving surface 45 contactable by forks 21*b* and 21*c*, and the clamp receiving surface 45 is substantially parallel to the first upper surface 41.

The second lower surface 42 defines a first partial annular ring portion 46 and a second partial annular ring portion 47 which contact the upper surface 24 of the fuel injector body 22. A pair of relief surfaces 48 are formed on the main body 40 between the first upper surface 41 and the second lower surface 42 of the clamping load distributor 20. The relief surfaces 48 are formed substantially parallel with the upper surface 41. The relief surfaces 48 are formed on the main body 40 by machining a channel 49 in the body transverse to the centerline X, which has a depth "t" as measured from the lower surface 42. The machining procedure produces a pair of channels 49 that are bounded by relief surfaces 48, first partial annular ring portion 46, and second partial annular ring portion 47.

It is understood that the channels 49 are formed on the main body 40 such that the clamp receiving portions 44 are axially aligned above the channels 49. In the preferred embodiment it is important Lo form the channels 49 relative to the clamp receiving portions 44 such that the static clamping load will be applied to the clamp receiving surface 45 at a position that is axially aligned such that it is intermediate a first end 48*a* and a second end 48*b* of the relief surface 48.

With reference to FIG. 5 there is illustrated the clamping load distributor 20 that provides a significant improvement in uniformly distributing the concentrated static clamping loads from the hold down clamp 21 to the first partial annular ring portion 46, and the second partial annular ring portion 47. In the preferred embodiment the hold down clamp 21 includes an embossment 21*f* formed on each of the forks 21*b* and 21*c* (only one fork is illustrated). The embossment projects outwardly from the lower surface 21*d* of fork 21 and defines a surface 21*g* that is substantially parallel with lower surface 21*d* of hold down clamp 21. The embossment 21*f* is formed such that when the hold down clamp 21 is installed the pair of surfaces 219 engage the clamp receiving surfaces 45 substantially centrally between a first end 45*a* and a second end 45*b* of surface 45. Relief surface 48 is formed such that its substantially central location between first end 48*a* and second end 48*b* is axially aligned with the substantially central location between first end 45*a* and second end 45*b* of surface 45.

The clamping load distributor 20 distributes the static clamping load from the clamp receiving portions 44 to the partial annular ring portions 46 and 47. Geometric relationships between clamp receiving portions 44 and the pair of partial annular ring portions 46 and 47, transfer the concentrated static clamping loads from the clamp receiving portions 44 to the upper surface 24 of fuel injector body 22. A resulting benefit of distributing the concentrated static clamping load from the hold down clamp 21 is a significant decrease in the distortion of the first cylindrical bore 32 which has the timing plunger 33 slideably disposed within. By decreasing the distortion of the first cylindrical bore 32 there is a corresponding reduction of the scuffing of timing plunger 32 (FIG. 2). The reduction of timing plunger 33 scuffing minimizes or eliminates the occurrence of timing plunger seizure.

Figure 5A:
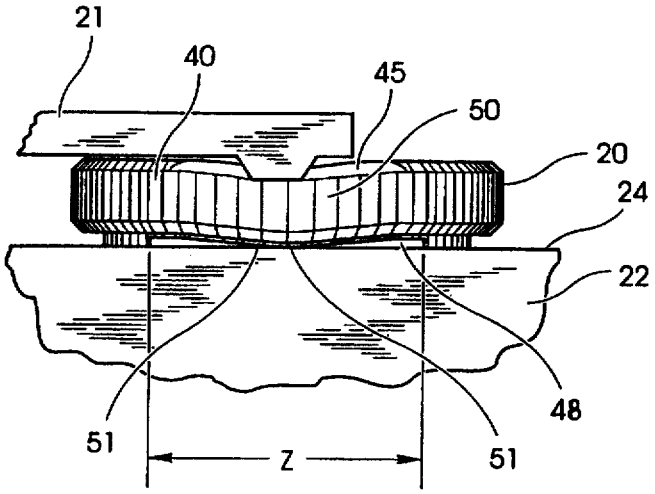
FIG. 5A is a side elevational view of the FIG. 1 clamping load distributor being elastically deformed by a clamping load.

Referring to FIG. 5A, there is illustrated the clamping load distributor 20 in a elastically deformed state. When a predetermined amount of force is applied by the hold down clamp 21 to the clamping load distributor 20 a portion of the main body 40 is elastically deformed. In an alternate embodixnent plastic deformation of the clamping load distributor is contemplated. The elastic deformation allows a substantially central portion of the relief surface 48 to contact the upper surface 24 of the fuel injector body 22. The deformation occurs in a portion 50 of the main body 40 which is located between the clamp receiving surface 45, and the relief surface 48. In FIG. 5A, there is only shown one deformable portion 50, however, it is understood that a second deformable portion is located diametrically opposed on the main body. The localized deformation of the main body causes a section 51 of the relief surface 48, located intermediate the first end 48*a* and the second end 48*b* of surface 48, to contact the upper surface 24 of the fuel injector body 22. A resulting benefit is that the concentrated clamping load from hold down clamp 21 is distributed through an additional location to the upper surface 24 of the fuel injector body 22. The clamping load distributor 20 when in its second state defines six contact points for distributing the concentrated clamping load from the clamping forks 21*b* and 21*c*.

The width Z of channel 49 is dependent upon the material properties of main body 40 and the clamping force transmitted by the down clamp 21, and the depth "t" of channel 49. It is understood that the width Z varies depending on the aforementioned factors, and that other combinations of width Z and depth "t" of channel 49 are contemplated. In the preferred embodiment the depth "t" is 0.3 millimeters.

Figure 6:
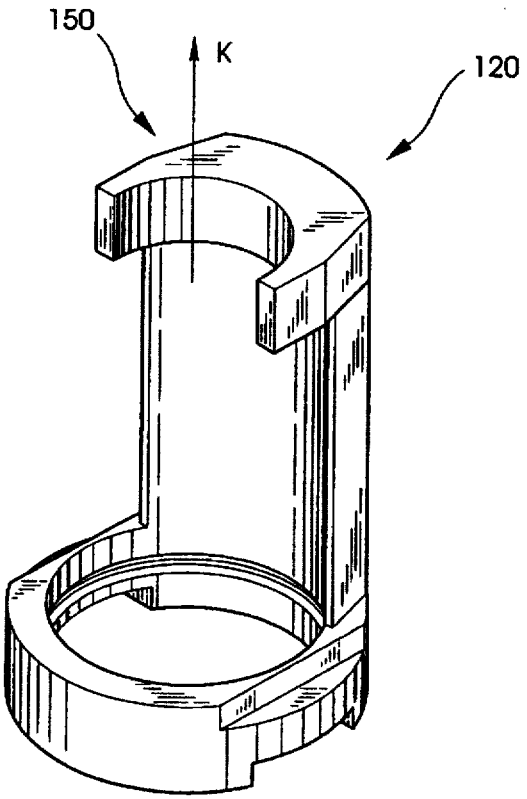
FIG. 6 is a perspective view of a clamping load distributor according to another embodiment of the present invention.

The clamping load distributor 120 that is illustrated in FIG. 6, corresponds to a second form of the present invention. The general construction and function of the corresponding clamping load distributor 120 is substantially the same as the clamping load distributor 20 in virtually all aspects. In clamping load distributor 120 there is an integrally formed top stop portion 150 that functions to control the movement of the coupling member 35. The top stop portion 150 limits the outward axial movement of the coupling member 35 and the link 36 in the direction of arrow K. This limitation creates a small gap between the moving mechanical parts in the valve train to allow a coating of lubrication to be obtained. It is understood that other elements, analogous to the top stop portion 150, can be integrated with the clamping load distributor 120 to improve the performance and reliability of the fuel injector unit 23.

Figure 7:
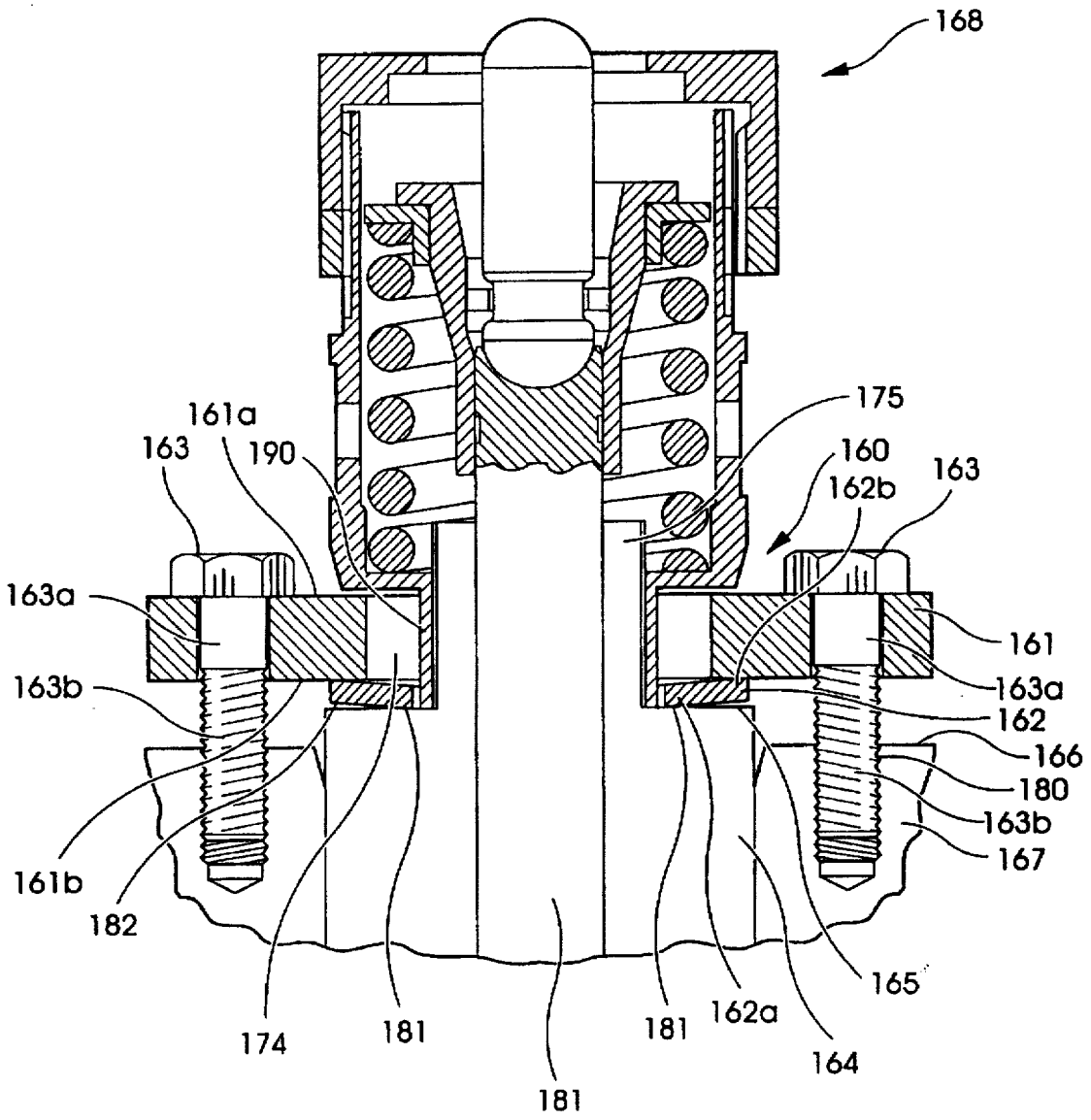
FIG. 7 is a front elevational view in full section of a clamping load distributor according to another embodiment of the present invention positioned on the fuel injector body.
Figure 8:
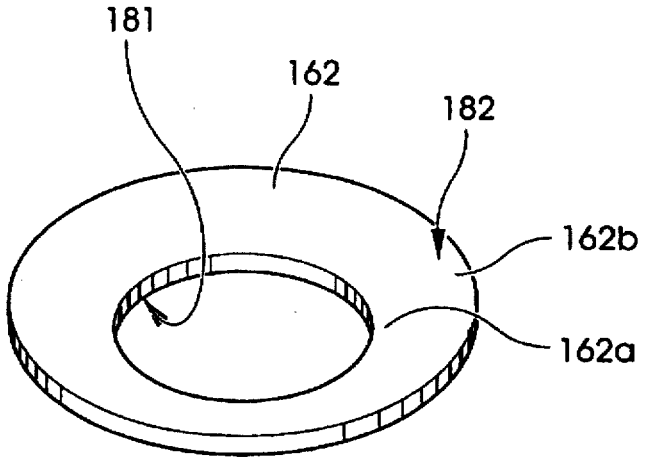
FIG. 8 is a perspective view of a spring washer comprising a portion of the FIG. 7 combination.
Figure 9:
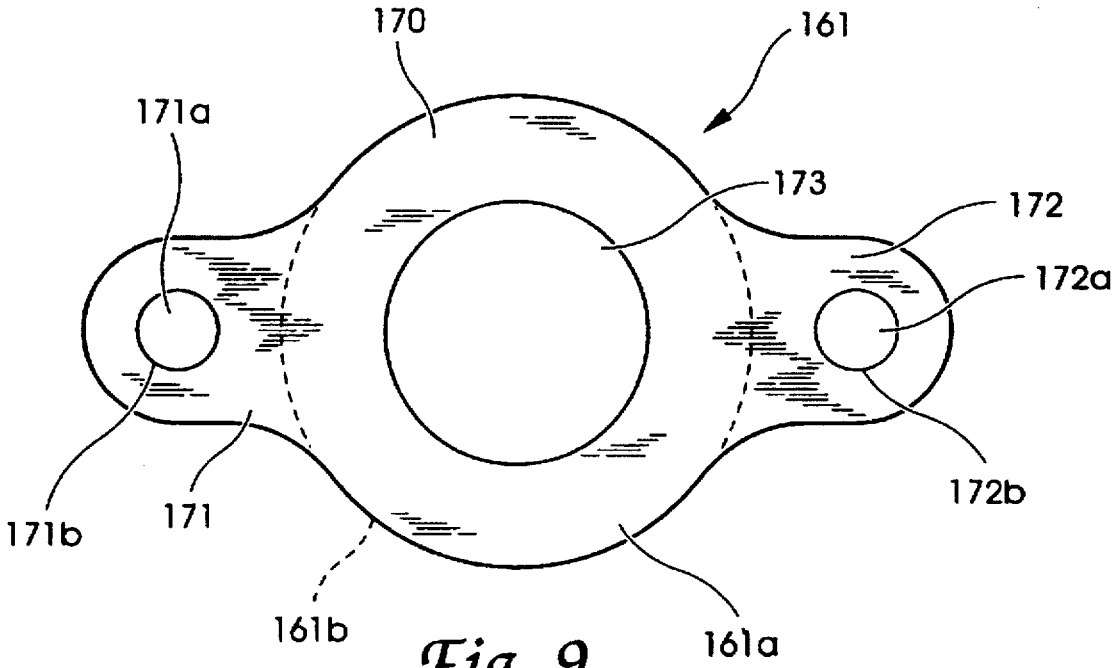
FIG. 9 is a top plan view of a clamp comprising a portion of the FIG. 7 combination.

With reference to FIGS. 7–9, there is illustrated another form of the present invention. The clamping load distributor 160 comprises a clamp 161, a spring washer 162, and a pair of fasteners 163. Clamping load distributor 160 is designed to reduce the concentrated point loading associated with a hold down clamp, and transmit a more uniformly distributed static clamping load to the fuel injector body 164. The clamping load distributor 160 is assembled onto the fuel injector body 164 between an upper surface 165 of the fuel injector body 164 and a deck 166 of a cylinder head 167.

The hold down clamp 161 is provided for securing the fuel injector body 164 to the cylinder head 167 of an internal combustion engine (not illustrated). The clamp 161 can be viewed or thought of as having three portions or sections. The three portions or sections include a substantially cylindrical main body portion 170, a first flange portion 171, and a second flange portion 172. The main body portion 170 includes a first upper surface 161*a*, and a second lower surface 161*b* which is disposed opposite of the first upper surface 161*a*. The first upper surface 161*a* is substantially parallel to the second lower surface 161*b* of the clamp 161. If extended along the imaginary broken lines the main body portion 170 is of substantially cylindrical shape and has a bore 173 extending therethrough between the first upper surface 161*a* and the second lower surface 161*b*. An internal diameter surface 174 is defined on bore 173, and this internal diameter surface 174 is larger than the outside diameter of upstanding cylindrical portion 175 of fuel injector body 164. This relative difference in diameter size permits the clamp 161 to be situated circumferentially around the depending portion #190 of fuel injector body sleeve.

The pair of flange portions 171 and 172 are integrally formed adjacent the main body portion 170. The flange portions 171 and 172 extend outwardly from the main body portion 170 and have apertures 171*a* and 172*a* extending therethrough. The apertures 171*a* and 172*a* define an internal diameter surface 171*b* and 172*b*, and this internal diameter surface is larger than the outside diameter of a shank 163*a* of fastener 163. This relative difference in diameter size permits the shank 163*a* of fasteners 163 to pass through the apertures 171*a* and 172*a* to engage the deck 166 of cylinder head 167. The fasteners 163 are externally threaded on a first portion 163*b*, which is receivable within a correspondingly internally threaded bore 180 in cylinder head 167. In the preferred embodiment the threaded fastener is a hexhead bolt. The torquing of fasteners 163 transmits a hold down clamp load through the clamp 161 to the spring washer 162, thereby holding the fuel injector body 164 in place relative to the cylinder head 167.

In the preferred embodiment the spring washer 162 is defined by a Belleville washer. The spring washer 162 has a first annular ring portion 162*a* and a second annular ring portion 162*b*. The first annular ring portion 162*a* defines an annular surface 181 that is normally in contact with the upper surface 165 of the fuel injector body 164. The second annular ring portion 162*b* defines an annular surface 182 that is normally biased outwardly from the upper surface 165 of the fuel injector body 164. The spring washer 162 is preferably formed from a heat treated spring steel.

With reference to FIG. 7 there is illustrated fuel injector unit 168 having a clamping load distributor 160 installed between the upper surface 165 of the fuel injector body and the cylinder head 167. The torquing of fasteners 163 transmit a hold down clamping load through the clamp 161 to the spring washer 162, thereby holding the fuel injector body 164 in position on the cylinder head 167. The torquing of the fasteners 163 draws the annular surface 182 of the second annular ring portion 162*b* toward the upper surface 165 of the fuel injector body 164 such that an additional area of contact results. A resulting benefit is that the static clamping load is uniformly distributed across the upper surface 165 of the fuel injector body 164. The uniformly distributed load causes a reduction in timing plunger scuffing, thereby eliminating or minimizing the occurrence of timing plunger seizure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus disposed between an internal combustion engine's fuel injector body and a clamping device, said apparatus comprises:

a substantially cylindrical body having a clamp engagement portion for receiving the clamping device, wherein the clamping device imparts a clamping load to said clamp engagement portion of said body when in a loaded condition;

said body having a first surface and a second surface opposite thereto with an aperture extending between said first and second surface for receiving a portion of the fuel injector body therethrough, said body having at least one relief surface axially aligned with said clamp engagement portion and formed between said first surface and said second surface;

said first surface comprising a first portion and a second portion, said first portion normally contacting the fuel injector body and said second portion being spaced from the fuel injector body when said clamping load is not applied, said body being deformable upon applying said clamping load thereto so that said second portion contacts the fuel injector body for distributing the clamping load; and wherein the clamping device including a clamp having a first end and an opposite second end, said first end coupled to the internal combustion engine, said second end defines a pair of spaced apart forks positioned to contact said clamp engagement portion, and a fastener for attaching the clamp to the internal combustion engine.

2. The apparatus of claim 1, wherein said pair of forks having an embossment extending therefrom.

3. The apparatus of claim 2, wherein said embossment contacts said clamp engagement portion substantially centrally.

4. The apparatus of claim 3, wherein at least a portion of said body being deformable when in a loaded condition.

5. The apparatus of claim 4, wherein at least a portion of said relief surface contacts said fuel injector body when in a loaded condition.

6. A clamping load distributor situated between a fuel injector body and a clamping device, said clamping load distributor comprises:

a cylindrical body having a first end and an opposite second end, said cylindrical body having an aperture extending between said first end and said second end for receiving an upstanding portion of the fuel injector body therethrough;

a pair of partial annular rings extending longitudinally from said second end of said body for contacting the fuel injector body, said pair of partial annular rings being spaced apart by a pair of diametrically opposed channels;

said body having a pair of clamping device receiving portions formed diametrically opposed to each other on said first end, said pair of clamping device receiving portions arranged for receiving a clamping load from the clamping device; and said pair of clamping device receiving portions being axially aligned with said pair of channels.

7. The clamping load distributor of claim 6, wherein each of said channels defines a relief surface.

8. The clamping load distributor of claim 7, wherein each of said relief surfaces being formed between said first end and said second end of said cylindrical body.

9. The clamping load distributor of claim 8, wherein at least a portion of each of said relief surfaces contacts the fuel injector when in a loaded condition.

10. The clamping load distributor of claim 9, which further comprises an internal combustion engine, and wherein said clamping device includes:

a clamp having a first end and an opposite second end, said first end coupled to the internal combustion engine, said second end defines a pair of spaced apart forks positioned to contact said clamp engagement portion; and a fastener for attaching the clamp to the internal combustion engine.

11. An apparatus for securing a fuel injector body to a cylinder head, said apparatus comprises:

a flexible spring plate having a first surface and a second surface opposite said first surface, at least a portion of said second surface normally disposed adjacent said fuel injector body;

said spring plate comprising a belleville washer and having an aperture extending therethrough for receiving a portion of the fuel injector body;

said spring plate having an edge biased to an outward position away from said fuel injector body but being depressible from said outward position; and a clamp having a substantially cylindrical main body portion and a pair of flange portions extending from said main body portion, said clamp for exerting a clamping load on said upper surface of the flexible spring plate to resiliently urg said edge towards the fuel injector body for distributing the clamping load.

12. The apparatus of claim 1, wherein said flange portions extending diametrically opposed from said main body portion.

13. The apparatus of claim 1, which further includes an top stop portion connected to said body for limiting the axial movement of a member coupled to the internal combustion engine.

14. The apparatus of claim 13, wherein said member defines a coupling member.

15. The apparatus of claim 6, which further includes an internal combustion engine having a valve train, the apparatus being coupled to the internal combustion engine, and further including an integral top stop portion formed on said body for limiting the movement of a member coupled to said valve train.

* * * * *

UNITED STATES PATENT AND TRADEMARK OFFICE
CERTIFICATE OF CORRECTION

PATENT NO. : 5,697,345

DATED : December 16, 1997

INVENTOR(S) : David P. Genter et al.

It is certified that error appears in the above-identified patent and that said Letters Patent is hereby corrected as shown below:

On the title page:

Under the heading "Attorney, Agent, or Firm", please change "Moriarity" to --Moriarty--.

In col. 3, line 14, please change "oil" to --on--.

In col. 4, line 22, please delete the second period.

In col. 4, line 1, please change "228" to --22a--.

In col. 4, line 44, please change "time" to --the--.

In col. 5, line 32, please change "Lo" to --to--.

In col. 5, line 50, please change "219" to --21g--.

In col. 6, line 11, please change "dixnent" to --diment--.

In col. 10, line 5, please change "urg" to --urge--.

Signed and Sealed this

Nineteenth Day of May, 1998

Bruce Lehman

*Attest:*

BRUCE LEHMAN

*Attesting Officer*

*Commissioner of Patents and Trademarks*